United States Patent [19]

Blackburn et al.

[11] Patent Number: 4,799,520

[45] Date of Patent: Jan. 24, 1989

[54] COVER FOR CHRISTMAS TREES

[76] Inventors: James H. Blackburn; Maureen T. Blackburn, both of 101 Chantilly, West Monroe, La. 71291

[21] Appl. No.: 138,055

[22] Filed: Dec. 28, 1987

[51] Int. Cl.[4] ..... B65D 81/00

[52] U.S. Cl. ..... 150/52 R

[58] Field of Search ..... 150/52 R

[56] References Cited

U.S. PATENT DOCUMENTS

| | | | |
|---|---|---|---|
| 1,446,416 | 2/1923 | Curtiss | 150/52 R |
| 2,781,811 | 2/1957 | Dilar et al. | 150/52 R |
| 2,911,025 | 11/1959 | Paros | 150/52 R |
| 3,750,731 | 8/1973 | Brimmell | 150/52 R |
| 3,954,129 | 5/1976 | Rudell et al. | 150/52 R |
| 4,384,604 | 5/1983 | DeLaura et al. | 150/52 R |

*Primary Examiner*—William Price

*Attorney, Agent, or Firm*—John M. Harrison

[57] ABSTRACT

A cover for Christmas trees which includes a tree-encapsulating bag or sheath provided with a center opening for receiving the trunk of the tree, a center string sleeve encircling the center opening and slidably containing a center perimeter string for tightening the center segment of the sheath against the trunk and an outside perimeter sleeve for containing an outside perimeter string, wherein the sheath can be extended entirely around the limits of the tree and the outside perimeter string tightened, to encapsulate the major portion of the tree inside the sheath. Multiple radial string sleeves slidably containing radial strings are also provided in the sheath, for shaping the sheath into a simulated landscape by forming pleats and scallops in the sheath. The cover can therefore be utilized as a decorative blanket which simulates a snow-covered landscape beneath the tree and as a dust cover for storing artificial Christmas trees or as a disposable or reuseable encapsulating bag for containing the needles of natural Christmas trees when disposing of such trees.

19 Claims, 1 Drawing Sheet

COVER FOR CHRISTMAS TREES

BACKGROUND OF THE INVENTION

1. Field of the Invention

This invention relates to a cover for both artificial and natural Christmas trees, which cover includes a sheath having drawstrings at the perimeter and center thereof, for fitting over and encapsulating a Christmas tree and further including radial drawstrings for shaping pleats and scallops in the sheath to simulate a snowy landscape beneath the Christmas tree when the Christmas tree is deployed and decorated. The cover serves as a dust cover for storing an artificial Christmas tree and as an encapsulating throw-away or reuseable bag or wrap for a natural Christmas tree, in order to contain the shedded needles when the Christmas tree is discarded.

The cover of this invention is designed to provide an attractive, decorative, simulated snow-covered or alternative landscape or other decorative area beneath a Christmas tree when the tree is decorated, and also serves to catch and retain loose needles which fall from natural Christmas trees. Furthermore, the cover is designed to facilitate the wrapping and encapsulating of both natural and artificial Christmas trees quickly and efficiently, without damaging the limbs and the tree structure, and in the case of natural Christmas trees, without spreading the shedded needles over the display area.

The problem of moving natural Christmas trees from a display area to a trash site without spreading needles over the entire area of transport is well known. Furthermore, as the needles tend to shed during the Christmas season while the tree is displayed, they provide an unsightly accumulation on decorations such as nativity scenes, simulated snow fields or other decorations and gifts located beneath the tree. Furthermore, when the tree is moved, these needles are shed in great numbers and are frequently spread all over the display area, as well as throughout the house along the path of transport. Additionally, the dripping of exuded resins or gums from the tree can permanently damage rugs, carpeting or floors.

2. Description of the Prior Art

A patent search revealed a number of prior art patents concerned with various types of tree wraps and covers designed for enclosing trees for various purposes. These patents are summarized below and a copy of each is enclosed with this patent application.

U.S. Pat. No. 1,446,416, dated Feb. 20, 1923, to W. C. Curtiss, details a "Protective Cover For Fruit Trees". The protective cover detailed in this patent includes a generally jar-shaped, flexible cover which features a drawstring at the top and bottom for fitting over a fruit tree. An opening is maintained at the top of the cover, in order to facilitate circulation of air and heat from a smudge pot inserted beneath the cover to protect the tree from freezing. U.S. Pat. No. 3,954,129, dated May 4, 1976, to David C. Rudell, et al, details a "Christmas Tree Wrap, Floor or Rug Protector and Decorative Base". The device includes a substantially cylindrical wrapper which is open at the top and is fitted with a bottom having a central opening that is more narrow than the top opening. The bottom is adapted to cover a rug or floor and a supporting stand for the Christmas tree and is also designed to be fastened to the tree trunk above the stand. In a preferred embodiment of the invention, the wrap is constructed of 2–6 mil. polymeric film which may be decorated as desired. A "Christmas Tree Disposal Bag" is detailed in U.S. Pat. No. 4,384,604, dated May 24, 1983, to Andrew J. DeLaura. The bag is designed to prevent dry pine needles from falling on the floor while the tree is being carried out of the home and includes a small bottom opening, through which the tree trunk extends downward to a tree stand. When in collapsed configuration, the bag is draped over the tree stand, in order to hide the stand while the tree is being displayed during the Christmas season. An interior apron is fitted around a top opening in the bag and is constructed of fluffy cotton to resemble a snow field under the tree, portions of the cotton being impregnated with a stiffening material and compressed in molds to form miniature houses which are colored to resemble a village in a snowy landscape. The bag is pulled up around the tree and the top opening is closed to contain the needles when the tree is discarded.

It is an object of this invention to provide a new and improved cover for Christmas trees and other objects, which cover is designed to operate as a dust cover or sheath for artificial trees and a needle-containing, encapsulating throw-away or reuseable cover for natural trees.

Another object of the invention is to provide a cover or sheath for encapsulating Christmas trees during storage or disposal, which sheath includes a cover material constructed of a suitable fabric or plastic, a center draw string for tightening around the trunk of a Christmas tree and a perimeter draw string for enclosing the top portion of the Christmas tree, with radial drawstrings also provided in the sheath for shaping pleats or scallops in the sheath, in order to simulate a snow-covered landscape or provide an alternative decorative effect when the sheath is deployed beneath the tree in a decorative mode.

Still another object of the invention is to provide a wrap or cover for Christmas trees, which cover includes a sheath of sufficient diameter to substantially encapsulate a natural or artificial Christmas tree, a center drawstring provided at a central opening and slit in the sheath for tightening around the tree trunk, with multiple, radial strings extending from the center drawstring and an outer perimeter drawstring for tightening above the tree and encapsulating the tree inside the sheath, in order to contain the dry needles of a natural tree or shield an artificial tree from dust and damage during storage.

Still another object of the invention is to provide a cover for Christmas trees, which cover is characterized by a sheath having an opening and a slit in the center thereof for receiving the trunk of the tree, a center drawstring encircling the opening and emerging at the slit for tightening the center portion of the sheath around the trunk of the tree, a second perimeter drawstring provided in the outer perimeter of the sheath for tightening the sheath above the tree and substantially encapsulating the tree inside the sheath and further including multiple radial drawstrings extending from the center drawstring to the perimeter drawstring, for creating pleats and scallops in the sheath when the sheath is deployed beneath the Christmas tree, in order to simulate a decorative snow landscape or other decoration when the tree is decorated.

SUMMARY OF THE INVENTION

These and other objects of the invention are provided in a new and improved cover for Christmas trees, which cover includes a wrap or sheath having an opening in the center thereof for receiving the trunk of a tree, a center drawstring provided in a center sleeve substantially encircling the opening perimeter for tightening the center of the wrap or sheath around the trunk of the Christmas tree, a perimeter drawstring provided in a second sleeve located in the outer perimeter of the sheath, for tightening the sheath around the top of the Christmas tree, in order to encapsulate the Christmas tree inside the sheath and further including multiple radial drawstrings fitted inside additional radially-disposed sleeves provided in the sheath between the center draw string and the perimeter drawstring, for creating pleats and scallops in the sheath when the sheath is deployed beneath the tree and simulating a snow field, a landscape or seasonal decorations, when the tree is decorated.

BRIEF DESCRIPTION OF THE DRAWING

The invention will be better understood by reference to the accompanying drawing, wherein.

DESCRIPTION OF THE PREFERRED EMBODIMENTS

Figure 1:
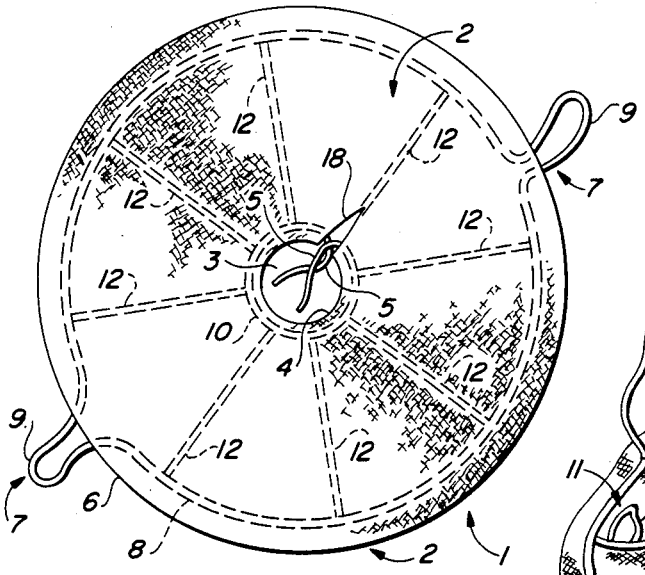
FIG. 1 is a top view of a preferred embodiment of the cover for Christmas trees of this invention.
Figure 2:
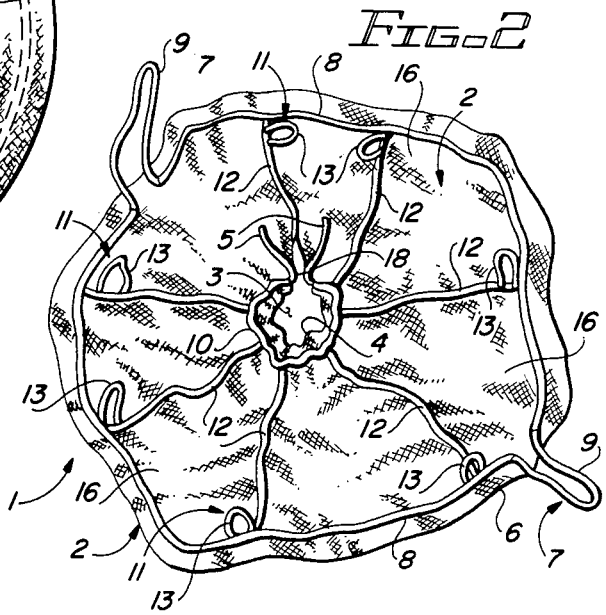
FIG. 2 is a bottom view of the cover illustrated in FIG. 1 with pleats and scallops shaped in the cover.
Figure 3:
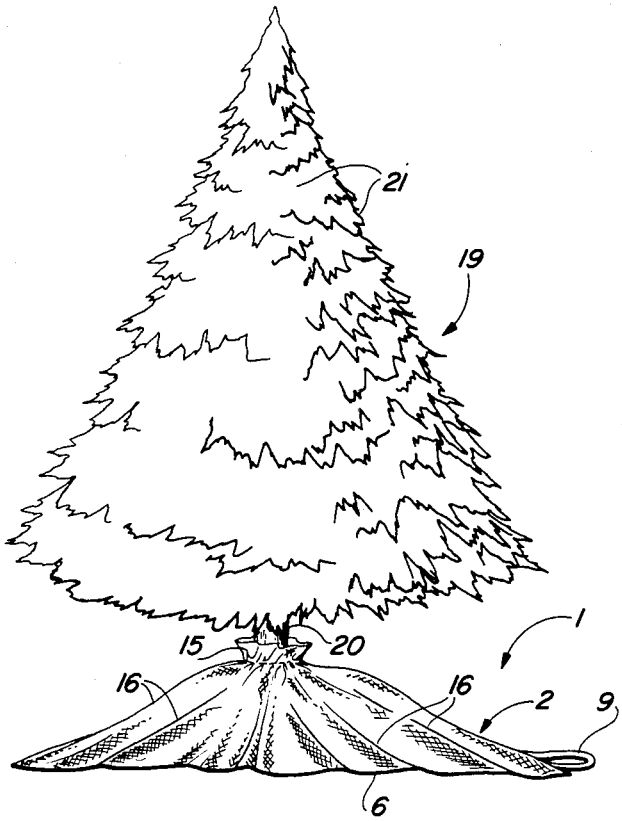
FIG. 3 is a front elevation of the cover for Christmas trees deployed in decorative mode beneath a Christmas tree to simulate a snow-covered landscape.

Referring initially to FIGS. 1–3 of the drawing, the cover for Christmas trees of this invention is generally illustrated by reference numeral 1. The cover 1 is characterized by a sheath 2 of sufficient diameter to encapsulate a Christmas tree of selected height, which sheath 2 includes a center opening 3 having an opening perimeter 4, with a sheath slit 18 provided in the opening perimeter 4 and a center draw string 5 inserted inside a center string sleeve 10, which terminates at the sheath slit 18. The ends of the center drawstring 5 extend from the center string sleeve 10 at the sheath slit 18 into the center opening 3, in order to tightly secure the opening perimeter 4 around the trunk 20 of a Christmas tree 19, as illustrated in FIG. 3. In a preferred embodiment, the sheath 2 is circular in configuration and extends outwardly to an outside perimeter 6, which is fitted with an outside perimeter sleeve 8, containing at least one outside perimeter string 7. In a most preferred embodiment of the invention, the outside perimeter string 7 is continuous in design and a pair of outside perimeter string loops 9 extend as oppositely-disposed segments of the outside perimeter string 7, from openings (not illustrated) in the outside perimeter sleeve 8, to facilitate tightening the outside perimeter 6 of the sheath 2 about the top of a Christmas tree, as hereinafter described. Multiple radial strings 11 are fitted inside companion radial string sleeves 12, which extend from the center string sleeve 10 to the outside perimeter sleeve 8 in the sheath 2. One end of each of the radial strings 11 is anchored inside the companion radial string sleeve 12 at the center string sleeve 10. In another preferred embodiment of the invention, as in the case of the outside perimeter string 7, each of the radial strings 11 is provided with a radial string loop 13, which extends through an opening (not illustrated) in each companion radial string sleeve 12. Under these circumstances, the opposite end of each of the radial strings 11 is anchored at the outside perimeter sleeve 8. Accordingly, in this preferred embodiment of the invention, the radial strings 11 are sewn at one end to the center string sleeve 10 at spaced intervals, respectively, and at the opposite end to the outside perimeter sleeve 8, in order to facilitate extension of the radial loops 13 from the companion openings in the radial string sleeves 12, respectively, and creation of the sheath contours 16 in the sheath 2, as illustrated in FIG. 2.

Referring again to FIGS. 1–3 of the drawing, when the cover 1 is deployed in decorative orientation as illustrated in FIG. 3, the trunk 20 of the Christmas tree 19 may be inserted through the center opening 3 of the sheath 2, the center perimeter string 5 is tightened around the trunk 20 and the ends are tied together to secure the opening perimeter 4 of the sheath 2 against the trunk 20 and create a bottom ruffle 15, as illustrated in FIG. 3. Alternatively, when the Christmas tree 19 is to be set up in indoors in a support 22, then the support 22 is first located on the floor, and the sheath 2 is positioned over the support 22, with the center opening 3 aligned with the trunk-receiving support cup 23. The center perimeter of the sheath 2 is then raised on the trunk 20 and the center drawstrings 5 are tightened on the trunk 5 at a desired position. The sheath slit 18 serves to facilitate protrusion of the top portion of the support cup 23 through the center opening 3 for treeinstallation and watering purposes. Furthermore, multiple sheath contours 16 of selected number, size and shape are created by exerting tension on the radial string loops 13 of the radial strings 11, in order to simulate a decorative effect such as a snow-covered landscape in the sheath 2 beneath the Christmas tree 19. Furthermore, the outside perimeter string loop 9 can also be adjusted and manipulated to create a desired number and size of additional sheath contours 16 in the outside perimeter 6, as further illustrated in FIG. 3.

Figure 4:
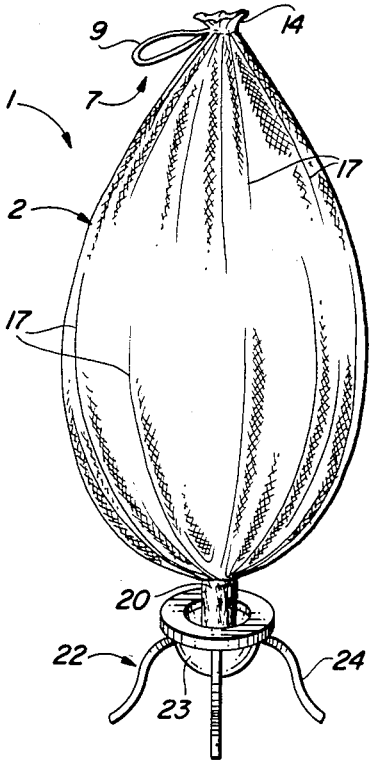
FIG. 4 is a front elevation of the cover illustrated in FIGS. 1–3 encapsulating the Christmas tree for disposal or storage of the Christmas tree.

Referring now to FIG. 4, when it is desired to encapsulate the Christmas tree 19. (which is supported by the support cup 23 and support legs 24 of the support 22) inside the sheath 2 of the cover 1, either for storage or disposal purposes, the outside perimeter 6 of the sheath 2 is extended outwardly of the trunk 20 and the sheath 2 is then spread upwardly over the Christmas tree 19. The outside perimeter string loop 9 is then tightened to close the outside perimeter 6 over the top of the Christmas tree 19 and create the top ruffle 14, as illustrated. This procedure creates multiple vertical sheath folds 17 in the sheath 2 and encloses the Christmas tree 19 inside the sheath 2. Such encapsulation or enclosure of the Christmas tree 19 inside the sheath 2 insures that needles will not be spread from a natural Christmas tree 19 over the house during transportation of the Christmas tree from the house to a trash site. Furthermore, the encapsulation ensures that an artificial Christmas tree 19 will be protected from the accumulation of dust during storage. Accordingly, after the Christmas tree 19 is secured inside the sheath 2, the trunk 20 can be removed from the support 22 and either discarded or stored, as appropriate.

It will be appreciated by those skilled in the art that the cover for Christmas trees detailed herein may be constructed of substantially any desired material, including paper, fabric or a plastic sheet material of selected thickness, such as polyethylene or polypropylene, in non-exclusive particular. Furthermore, the cover can be scented and decorated and may be round or shaped in the configuration of a regular or irregular polygon, such as a square or rectangle, as desired. The cover can be configured in any desired shape, with or without a center opening 3, to fit furniture, Christmas wreaths and other items which need to be stored free of dust accumulation. Referring again to the drawing, under circumstances where the sheath 2 is shaped in the configuration of a regular polygon such as a hexagon, the radial string sleeves 12 may originate at the points of connection of the respective hexagon sides and extend inwardly of the sheath 2 in pie-shaped segments or wedges, to the center string sleeve 10.

It will be further appreciated that the center string sleeve 10, outside perimeter sleeve 8 and the radial string sleeves 12 can be replaced by spaced loops (not illustrated) for guiding, instead of encapsulating, the center drawstring 5, outside perimeter string 7 and radial string 11, respectively. Furthermore, the number and spacing of the radial string sleeves 12 and radial strings 11 will depend upon the size of the sheath 2.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A cover for a Christmas tree comprising a sheath having a selected configuration; an opening provided in said sheath for receiving the trunk of the Christmas tree; a center drawstring provided in said sheath adjacent said opening for tightening said sheath around the trunk; a perimeter drawstring provided in the perimeter of said sheath for selectively closing said sheath over the top of the Christmas tree and substantially encapsulating the Christmas tree inside said sheath; and at least one radial drawstring provided in said sheath between said opening and said perimeter, with one end of said radial drawstring anchored to said sheath, whereby said sheath may be disposed beneath the Christmas tree as a decorative member responsive to manipulation of said radial drawstring and said sheath.

2. The cover of claim 1 further comprising a center string sleeve provided in said sheath adjacent said opening for slidably containing said center drawstring; an outside perimeter sleeve provided in said perimeter of said sheath for slidably containing said perimeter drawstring; and at least one radial string sleeve provided in said sheath between said center string sleeve and said outside perimeter sleeve, for containing said radial drawstring.

3. The cover of claim 2 wherein said perimeter drawstring is continuous and longer than said perimeter of said sheath and at least one perimeter drawstring loop is shaped in said perimeter drawstring, said perimeter drawstring loop projecting from said outside perimeter sleeve, for selectively tightening said perimeter of said sheath over the top of the Christmas tree and said sheath around the Christmas tree.

4. The cover of claim 2 wherein said at least one radial drawstring further comprises a plurality of radial drawstrings having one end anchored to said sheath at said center string sleeve and further comprising a plurality of radial string sleeves extending from said center string sleeve to said outside perimeter sleeve, respectively, for containing said radial drawstrings in spaced relationship, respectively.

5. The cover of claim 4 wherein the opposite end of each of said radial drawstrings is anchored to said sheath at said outside perimeter sleeve, said radial drawstrings are longer than said radial string sleeves, respectively, and a radial drawstring loop is shaped- in each of said radial drawstrings, respectively, said radial drawstring loop projecting from said radial string sleeves, respectively, for selectively tightening said radial drawstrings and shaping pleats and scallops in said sheath when said sheath is disposed beneath the Christmas tree.

6. The cover of claim 1 wherein said perimeter of said sheath is substantially round and said opening is located substantially in the center of said sheath.

7. The cover of claim 6 further comprising a center string sleeve and a sheath slit provided in said sheath adjacent said opening for slidably containing said center drawstring; an outside perimeter sleeve provided in said perimeter of said sheath for slidably containing said perimeter drawstring; and at least one radial string sleeve provided radially in said sheath between said center string sleeve and said outside perimeter sleeve, for containing said radial drawstring.

8. The cover of claim 7 wherein said perimeter drawstring is continuous and longer than said perimeter of said sheath and a pair of perimeter drawstring loops are shaped in said perimeter drawstring, said perimeter drawstring loops projecting from said outside perimeter sleeve in oppositely-disposed relationship, for selectively tightening said perimeter of said sheath over the top of the Christmas tree and said sheath around the Christmas tree.

9. The cover of claim 8 wherein said at least one radial drawstring further comprises a plurality of radial drawstrings having one end anchored to said sheath at said center string sleeve and further comprising a plurality of radial string sleeves extending in radially spaced relationship from said center string sleeve to said outside perimeter sleeve, respectively, for containing said radial drawstrings, respectively.

10. The cover of claim 1 wherein said perimeter of said sheath is shaped substantially in the configuration of a regular polygon and said opening is located substantially in the center of said sheath.

11. The cover of claim 10 further comprising a center string sleeve provided in said sheath adjacent said opening for slidably containing said center drawstring; an outside perimeter sleeve provided in said perimeter of said sheath for slidably containing said perimeter drawstring; and at least one radial string sleeve radially disposed in said sheath between said center string sleeve and said outside perimeter sleeve, for containing said radial drawstring and wherein said perimeter drawstring is continuous and longer than said perimeter of said sheath and at least one perimeter drawstring loop is shaped in said perimeter drawstring, said perimeter drawstring loop projecting from said outside perimeter sleeve for selectively tightening said perimeter of said sheath over the top of the Christmas tree and said sheath around the Christmas tree.

12. The cover of claim 13 wherein said at least one radial drawstring further comprises a plurality of radial drawstrings having one end anchored to said sheath at said center string sleeve and further comprising a plurality of radial string sleeves extending in radially spaced relationship from said center string sleeve to said outside perimeter sleeve, respectively, for containing said radial drawstrings in slidable relationship, respectively.

13. The cover of claim 12 wherein the opposite end of each of said radial drawstrings is anchored to said sheath at said outside perimeter sleeve, said radial drawstrings are longer than said radial string sleeves, respectively, and a radial drawstring loop is shaped in each of said radial drawstrings, said radial drawstring loop projecting from said radial string sleeves, respectively, for selectively tightening said radial drawstrings and shaping pleats and scallops in said sheath when said sheath is disposed beneath said Christmas tree.

14. A cover for substantially encapsulating a Christmas tree, comprising a sheath having a substantially round perimeter and an opening provided substantially in the center of said sheath., a center drawstring provided in said sheath around said opening; an outside perimeter drawstring provided in said perimeter of said sheath; and a plurality of radial drawstrings radially disposed in said sheath between said center drawstring and said outside perimeter drawstring, with one end of each of said radial drawstrings secured to said sheath, whereby said sheath may be wrapped around the Christmas tree responsive to tightening said center drawstring around the trunk of said Christmas tree and tightening said outside perimeter drawstring above said Christmas tree in encapsulating mode, and said sheath may be disposed beneath said Christmas tree to simulate a landscape responsive to manipulation of said radial drawstrings, in decorative mode.

15. The cover of claim 14 further comprising a center drawstring sleeve and a sheath slit provided in said sheath substantially encircling said opening, for slidably receiving said center drawstring; an outside perimeter sleeve provided in said perimeter of said sheath and substantially encircling said perimeter, for slidably receiving said perimeter drawstring; and a plurality of radial string sleeves radially disposed in said sheath between said bottom string sleeve and said outside perimeter sleeve, for receiving said radial drawstrings, respectively.

16. The cover of claim 15 wherein:

(a) said perimeter drawstring is continuous and longer than said perimeter of said sheath and a pair of perimeter drawstring loops are shaped in said perimeter drawstring, said perimeter drawstring loops projecting from said outside perimeter sleeve in oppositely-disposed relationship, for selectively tightening said perimeter of said sheath over the top of the Christmas tree and said sheath around the Christmas tree in said first mode; and (b) both ends of said radial drawstrings are anchored to said sheath and said radial drawstrings are longer than said radial string sleeves, respectively, and a radial drawstring loop is shaped in each of said radial drawstrings, said radial drawstring loop projecting from said radial string sleeves, respectively, for selectively shortening that portion of said radial drawstrings which are located in said radial string sleeves, respectively, and shaping pleats and scallops in said sheath when said sheath is disposed in said second mode.

17. The cover of claim 16 wherein the perimeter of said sheath is shaped substantially in the configuration of a regular polygon.

18. A cover for selectively enclosing a Christmas tree and shaping a simulated landscape beneath the Christmas tree, comprising a sheath having a substantially round perimeter and an opening provided substantially in the center of said sheath; a center drawstring sleeve and a sheath slit extending from said opening through said center drawstring sleeve provided in said sheath, said center drawstring sleeve substantially encircling said opening and a center drawstring slidably disposed in said center drawstring sleeve for tightening said sheath around the trunk of said Christmas tree; an outside perimeter sleeve substantially encircling said perimeter of said sheath and a perimeter drawstring slidably disposed in said outside perimeter sleeve for tightening said perimeter of said sheath over the top of said Christmas tree; a plurality of radial string sleeves radially disposed in said sheath between said center drawstring sleeve and said perimeter sleeve and a plurality of radial drawstrings slidably disposed in said radial drawstring sleeves, respectively, with one end of each of said radial drawstrings secured to said sheath at said center drawstring sleeve, respectively, whereby said sheath may be secured around the Christmas tree responsive to tightening said center drawstring around the trunk of the Christmas tree and tightening said perimeter drawstring above the Christmas tree, respectively, in a first mode, and said sheath may be disposed beneath the Christmas tree to simulate a landscape responsive to manipulation of said radial drawstrings, in a second mode.

19. The cover of claim 18 wherein:

(a) said perimeter drawstring is continuous and longer than said perimeter of said sheath and a pair of perimeter drawstring loops are shaped in said perimeter drawstring, said perimeter drawstring loops projecting from said sheath slit at said outside perimeter sleeve for selectively tightening said perimeter of said sheath over the top of the Christmas tree and said sheath around the Christmas tree in said first mode; and (b) the opposite end of each of said radial drawstrings are secured to said sheath at said outside perimeter sleeve, respectively, said radial drawstrings are longer than said radial string sleeves, respectively, and a radial drawstring loop is shaped in each of said radial drawstrings, said radial drawstring loop projecting from said radial string sleeves, respectively, for selectively tightening said radial drawstrings and shaping pleats and scallops in said sheath when said sheath is disposed in said second mode.

* * * * *